US006225912B1

(12) United States Patent
Tanaka et al.

(10) Patent No.: US 6,225,912 B1
(45) Date of Patent: May 1, 2001

(54) LIGHT-EMITTING DIODE ARRAY

(75) Inventors: Hideo Tanaka; Hiroshi Mabuchi, both of Hitachi; Tamotsu Nishiura, Kawasaki, all of (JP)

(73) Assignees: Hitachi Cable, Ltd., Tokyo; Fujitsu Limited, Kanagawa-Ken, both of (JP)

( * ) Notice: Subject to any disclaimer, the term of this patent is extended or adjusted under 35 U.S.C. 154(b) by 0 days.

(21) Appl. No.: 09/339,112

(22) Filed: Jun. 24, 1999

(30) Foreign Application Priority Data

Jul. 16, 1998 (JP) ..... 10-202216

(51) Int. Cl.[7] ..... G08B 21/00

(52) U.S. Cl. ..... 340/641; 340/660; 340/815.45; 345/39; 345/46; 362/800

(58) Field of Search ..... 340/641, 815.45, 340/815.47, 815.52, 660, 661; 362/800; 315/86, 87; 345/48, 46, 39

(56) References Cited

U.S. PATENT DOCUMENTS 4,068,216 * 1/1978 Brouwer et al. ..... 340/168 R
4,271,408 * 6/1981 Teshima et al. ..... 340/815.52
4,298,869 * 11/1981 Okuno ..... 340/815.45
4,654,584 * 3/1987 Bezos et al. ..... 340/815.45
5,208,584 * 5/1993 Kaye et al. ..... 340/907
5,444,390 * 8/1995 Bartlett et al. ..... 324/770
5,909,182 * 1/1999 Van Alstine et al. ..... 340/815.52

* cited by examiner

*Primary Examiner*—Edward Lefkowitz
*Assistant Examiner*—Davetta W. Goins
(74) *Attorney, Agent, or Firm*—Carter, Ledyard & Milburn

(57) ABSTRACT

It is an object of the invention to provide a LED array, in which faults of all the diodes can be instantaneously detected, even when an optical printer is operating, and various kinds of faults of the LEDs can be discriminated. In the LED array comprising plural LEDs arranged along a lone, each LED is provided with a comparator, which compares a terminal voltage of the LED with a variable reference voltage. The kind of fault of the LED can be discriminated on the basis of a relation between the reference voltage applied to the comparator and an output voltage thereof.

14 Claims, 7 Drawing Sheets

LIGHT-EMITTING DIODE ARRAY

FIELD OF THE INVENTION

The invention relates to a light-emitting diode array comprising plural light-emitting diodes (LEDs, hereinafter) arranged along a straight line, and especially to a LED array, in which faults of all the diodes can be instantaneously detected, even when an optical printer is operating, and various kinds of faults of the LEDs can be discriminated.

BACKGROUND OF THE INVENTION

A LED array, which comprises plural LEDs arranged along a straight line, is used as a printing head of an optical printer. As shown in FIG. 1, the conventional LED array is composed of plural LEDs 1, transistors 2 serving as drivers for on/off controlling turning-on currents supplied to individual LEDs, a driving voltage supply terminal (+) 4 for supplying a power supply voltage of positive polarity, a driving voltage supply terminal (−) 5 for supplying a power supply voltage of negative polarity, and turning-on signal input terminals 6 for supplying on/off controlling signals to the drivers.

An anode of the LED 1 is connected with the driving voltage supply terminal (+) 4, a cathode of the LED 1 is connected with a drain of the transistor 2, a source of the transistor 2 is connected with the driving voltage supply terminal (−) 5, and a gate of the transistor 2 is connected with the turning-on signal input terminal 6. The LED 1 can be turned-on by applying a predetermined voltage to the turning-on signal input terminal 6.

When one of the LEDs becomes faulty, this diode is not turned-on, even when the turning-on signal is applied to a driver of the LED, so that a corresponding dot cannot be printed. Whether the LED is turned-on (lighted) or not can be discriminated by examinating the state of lightings of the LEDs using an external photosensor, or inspecting the actual results of printing, but such a particular examination or inspection is troublesome. Accordingly, it is desirable to develop a LED array having a function of discriminating the existence of a faulty LED.

Heretofore, following technologies have been proposed as the ones for detecting a faulty diode.

In a LED driver circuit disclosed in Japanese Patent Kokai 1-238075, each LED is provided with a reference voltage-generating circuit, which generates a reference voltage for monitoring a forward voltage of the LED, and a comparator for comparing the forward voltage of the LED with the reference voltage; and an extraordinary signal is generated in case that the forward voltage of the LED exceeds the reference voltage because of an imperfection of an electrical contact. Furthermore, an OR circuit for deriving a logical sum of the outputs the comparators is provided in the LED driver circuit. However, this LED driver circuit has not a function of detecting an short circuited faulty LED. Moreover, since the reference voltage-generating circuit is built in the LED driver circuit, it is no easy matter to adjust the reference voltage from the outside of the LED driver. Accordingly, it is very difficult to change a reference voltage adjusted for detecting imperfection of an electrical contact in a LED circuit into that suited for detecting the state of a deteriorating LED, before it is thoroughly faulty. Moreover, since several thousands of LEDs are used in a LED array in an optical printer, it is actually impossible to fabricate an OR circuit for driving a logical sum of the outputs of several thousands of comparators.

In a faulty LED-detecting circuit for a LED array disclosed in Japanese Patent Kokai 2-128865, a resistor for detecting a current supplied to a LED is connected in series therewith. In an ordinary case (in case that an optical printer is operating), the resistor is bypassed by a relay, and in case that a faulty diode is searched for, the relay is open-circuited and a voltage applied to both the ends of the resistor is inspected. However, according to this faulty LED detecting circuit, the faulty LED cannot be detected, while the optical printer is operating. Moreover, since a single resistor is commonly used for all the LEDs, all the LEDs must be inspected in regular order one by one, and it is impossible to detect plural faults of the LEDs instantaneously. Furthermore, since the value of the resistance of the resistor is fixed, this faulty diode-detecting circuit can be applied only to the case that the driving currents of all the LEDs are the same. Furthermore, according to the faulty LED-detecting circuit mentioned in the above, the LED is regarded as faulty in case that the driving current flowing to the LED is less than a predetermined value, this circuit cannot detect the short-circuited faulty diode.

In a faulty diode-detecting circuit disclosed in Japanese Patent Kokai 5-31956, a common anode voltage is applied to plural LEDs to be inspected, and turning-on signals are applied to gates of switching transistors, which are respectively connected with cathodes of the LEDs, in regular order synchronizing with a certain clock signal. The sum of the anode currents of the respective LEDs are detected by means of a toroidal coil. In case that a faulty diode with an infinite impedance is driven, the toroidal coil does not detect an anode current, so that the existence of the faulty LED can be detected. However, according to the faulty diode-detecting circuit mentioned in the above, a short-circuited diode cannot be detected. Furthermore, this circuit cannot be applied, while an optical printer is operating.

In a LED array disclosed in Japanese Patent Kokai 5-212905, a voltage-detecting resistor is connected with data lines for respectively supplying constant currents to LEDs via diodes, and a voltage detected thereby is supplied to a window comparator. However, the resistance of the voltage-detecting resistor must be high so that the light-emitting characteristic of the LED is not changed. In case that the LED is short-circuited, since the potential of the data line becomes zero, a voltage applied to both the ends of the voltage-detecting resistor connected with the cathode of the diode becomes uncertain. Moreover, it is impossible to set a reference voltage of the window comparator from the outside thereof. Furthermore, in case that the plural LEDs connected with a common voltage-detecting resistor are turned-on at the same time, all the currents flowing through the LEDs meet one another in the voltage-detecting resistor and the voltage cannot be exactly measured.

SUMMARY OF THE INVENTION

Accordingly, it is an object of the invention to solve the aforementioned problems, and provide an LED array, in which faults of all the diodes can be instantaneously detected, even when an optical printer is operating, and the states of various kinds of faults of the LEDs can be discriminated.

According to the feature of the invention, an LED array comprises:

plural LEDs arranged along a predetermined line, plural comparators, each of which compares a voltage of a predetermined electrode of the each LED with a common reference voltage, and means for notifying existence of one or more faulty diodes based on outputs of the plural comparators, wherein the common reference voltage is changed in accordance with a kind of a fault of the LED to be inspected.

BRIEF DESCRIPTION OF THE DRAWINGS

The invention will be explained in more detail in conjunction with appended drawings, wherein.

DESCRIPTION OF THE PREFERRED EMBODIMENTS

Thereafter, preferred embodiments of the invention will be explained in detail referring to appended drawings.

Figure 1:
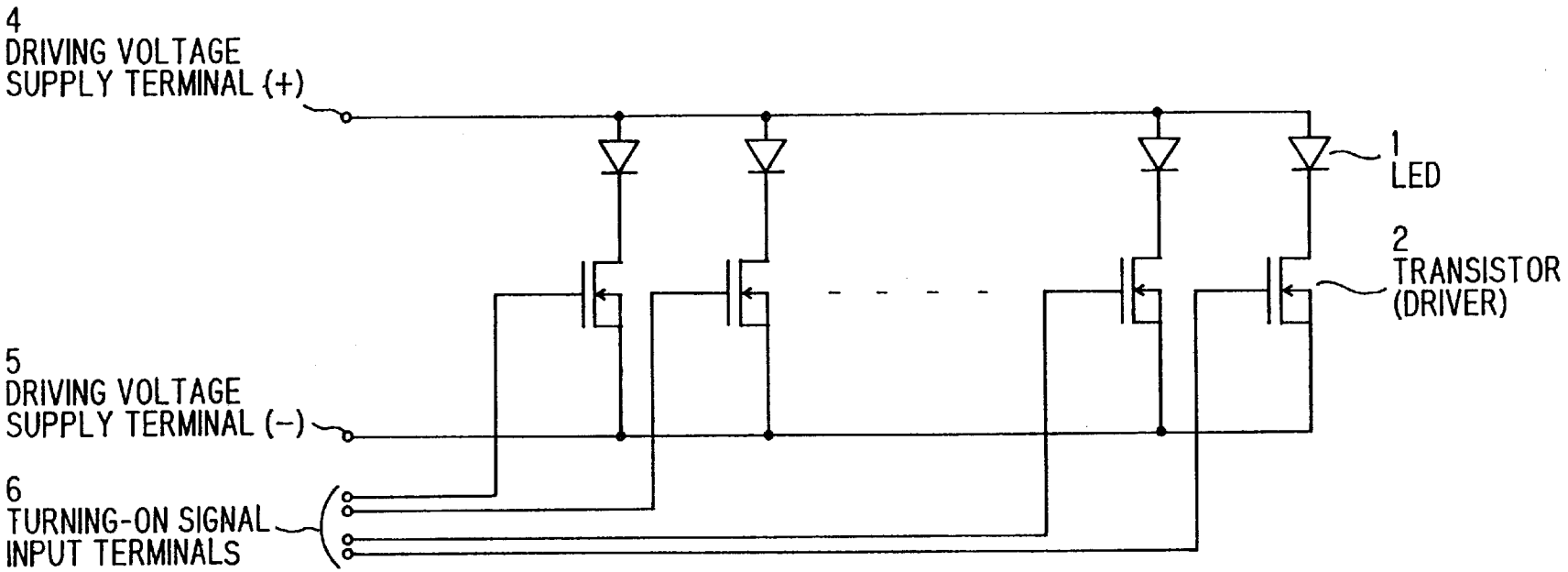
FIG. 1 PRIOR ART
FIG. 1 is a circuit diagram for showing a conventional LED array.
Figure 2:
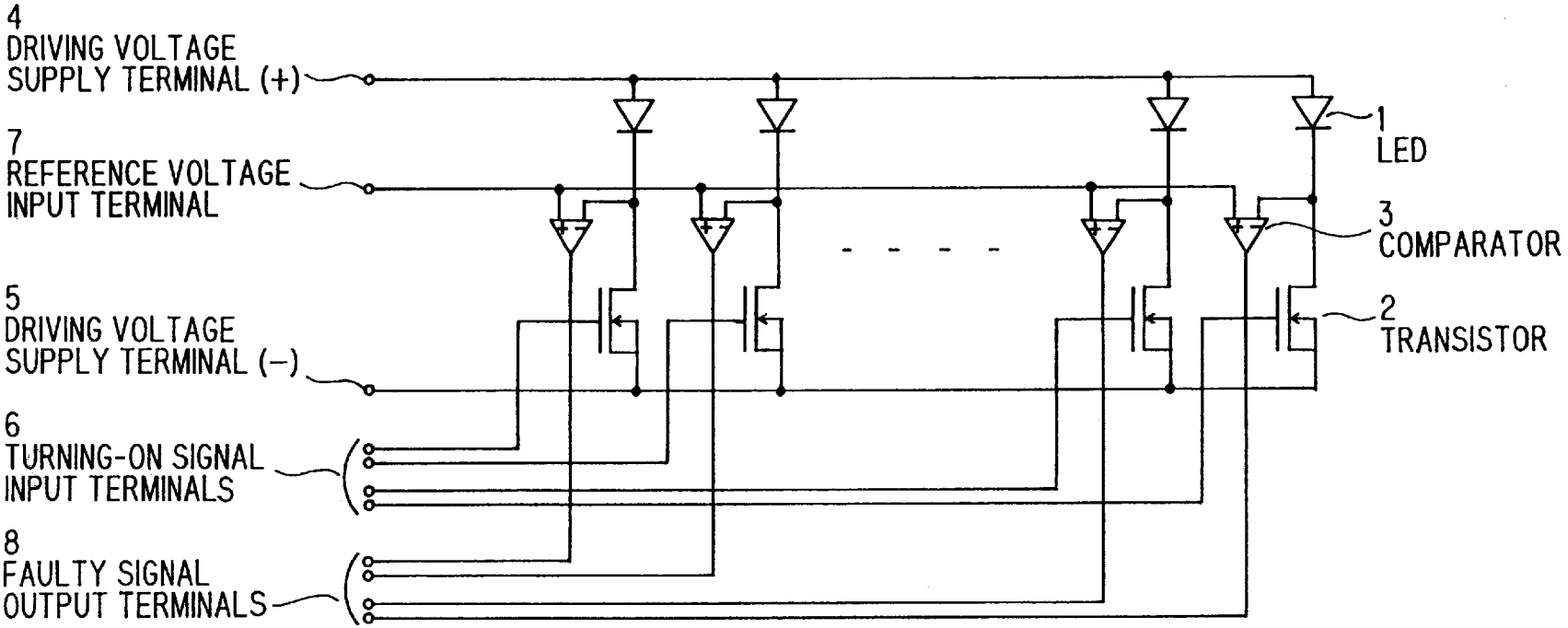
FIG. 2 is a circuit diagram for showing a LED array according to the first preferred embodiment of the invention.

As shown in FIG. 2, a LED array according to the first preferred embodiment of the invention is composed of plural LEDs 1, transistors 2 serving as drivers for turning on/off driving currents supplied to individual LEDs 1, comparators 3 for comparing cathode voltages of the LEDs 1 with a reference voltage, a common driving voltage supply terminal (+) 4 for supplying a power supply voltage of positive polarity, a common driving voltage supply terminal (−) 5 for supplying a power supply voltage of negative polarity, turning-on signal input terminals 6 for on/off controlling the drivers 2, a common reference voltage input terminal 7 for supplying the comparators 3 with a variable reference voltage, and faulty signal output terminals 8 for taking out the outputs of the comparators 3.

Although a reference voltage-generating circuit for supplying the reference voltage-supply terminal 7 with a reference voltage is not shown in the drawing, this circuit is mounted on an circuit board other than that mounting the LED array thereon.

An anode of the LED 1 is connected with the driving voltage-supply terminal (+) 4, the cathode of the LED 1 is connected with a drain of the transistor 2, a source of the transistor 2 is connected with the driving voltage supply terminal (−) 5, and a gate of the transistor 2 is connected with the turning-on signal input terminal 6. Moreover, a negative input terminal of the comparator 3 is connected with the cathode of the LED 1, a positive input terminal of the comparator 3 is connected with the reference voltage input terminal 7, and an output terminal of the comparator 3 is connected with the faulty signal output terminal 8.

An external voltage applied to the reference voltage input terminal 7 can be selected at will. For example, the voltage applied to the reference voltage input terminal 7 is lower than a voltage of the driving voltage supply terminal (+) 4, and is higher than a voltage derived by subtracting a forward voltage $V_F$ of the normal LED from the voltage of the driving voltage supply terminal (+) 4. In another way of selecting the voltage to be applied to the reference voltage input terminal 7, this value is lower than the voltage derived by subtracting the forward voltage $V_F$ of the normal LED from the voltage of the driving voltage supply terminal (+) 4. In the circuit shown in FIG. 2, the voltage applied to the reference voltage input terminal 7 is selected so that it is lower than the voltage of the driving voltage supply terminal (+) 4, and is higher than the voltage divided by subtracting the forward voltage $V_F$ of the normal LED from the voltage of the driving voltage supply terminal (+) 4.

In case that the LED I is normally operating, the negative terminal of the comparator 3 is supplied with the voltage derived by subtracting the forward voltage $V_F$ of the normal LED from the voltage of the driving voltage supply terminal (+) 4. Since this voltage is lower than the reference voltage supplied to the positive terminal of the comparator 3, the output voltage of the comparator 3 is at a high logical level (H level, hereinafter), and H level is applied to the faulty signal output terminal 8. In case that the LED 1 is not normally operating, that is to say, in case that the LED is short-circuited by a fault, since the voltage applied to the negative input terminal of the comparator 3 is higher than the reference voltage, the output voltage of the comparator 3 is at a low logical level (L level, hereinafter). In this way, the potential of the faulty signal output terminal is at H level in case the LED 1 is normal, and at L level in case that the LED 1 is faulty.

Figure 3:
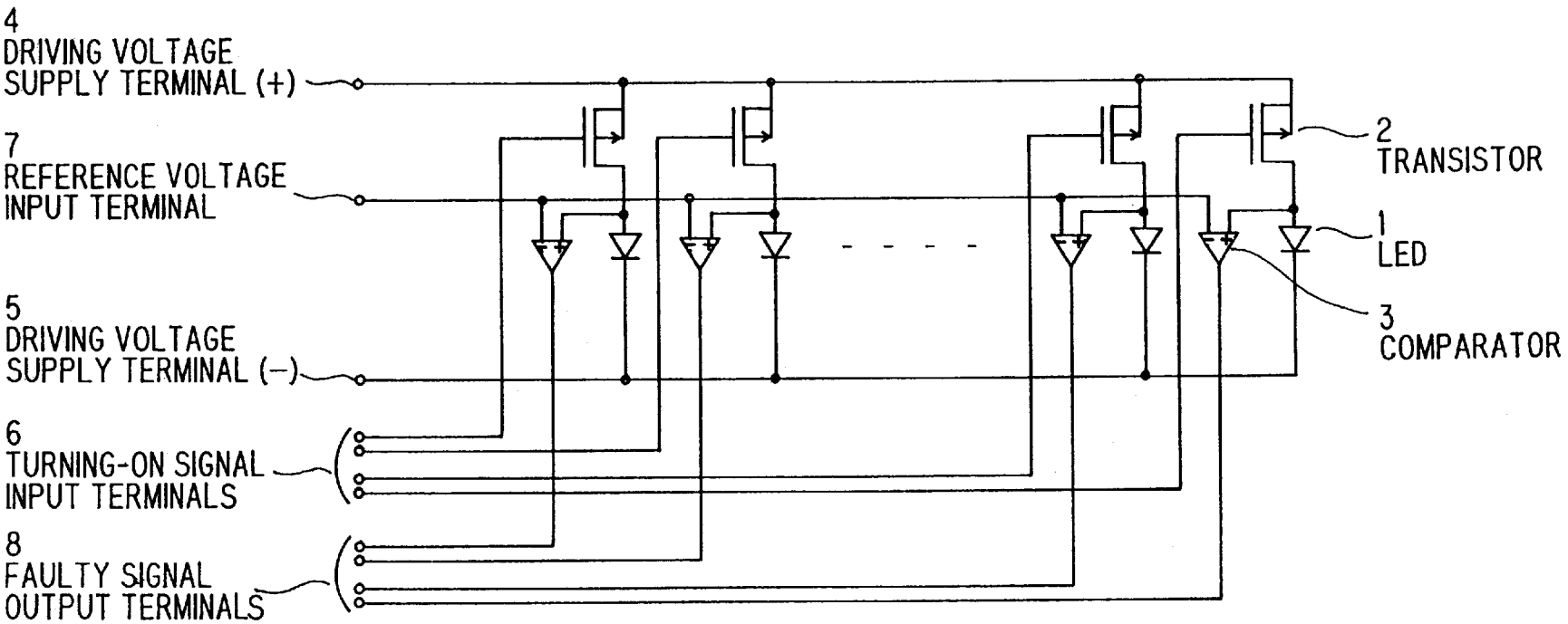
FIG. 3 is a circuit diagram for showing a LED array according to the second preferred embodiment of the invention.

FIG. 3 shows the second preferred embodiment of the invention.

As shown in FIG. 3, a LED array according to the invention is composed of plural LEDs 1, transistors 2 serving as drivers for on/off controlling the individual LEDs, comparators 3 for comparing anode voltages of the LEDs with a reference voltage, a driving voltage supply terminal (+) 4 for supplying a power supply voltage of positive polarity, a driving voltage supply terminal (−) 5 for supplying a power supply voltage of negative polarity, turning-on signal input terminals 6 for on/off controlling the drivers 2, a common reference voltage input terminal 7 for supplying the comparators 3 with a variable reference voltage, and faulty signal output terminals 8 for taking out the output signals of the comparators 3.

A cathode of the LED 1 is connected with the driving voltage supply terminal (−) 5, an anode of the LED 1 is connected with a source of the transistor 2, a drain of the transistor 2 is connected with the driving voltage supply terminal (+) 4, and a gate of the transistor 2 is connected with a turning-on signal input terminal 6. Moreover, a positive input terminal of the comparator 3 is connected with an anode of the LED 1, a negative input terminal of the comparator 3 is connected with a reference voltage input terminal 7, and an output terminal of the comparator 3 is connected with a faulty signal output terminal 8.

An external voltage supplied to the reference voltage input terminal 7 can be selected at will. For example, a voltage applied to the reference voltage input terminal 7 is higher than a voltage of the driving voltage supply terminal (−) 5, and lower than a voltage derived by adding a forward voltage $V_F$ of the normal LED 1 to the voltage of the driving voltage supply terminal (−) 5. In another way of selecting the voltage to be applied to the reference voltage input terminal 7, this voltage is higher than the voltage derived by adding the forward voltage $V_F$ of the normal LED 1 to the voltage of the driving voltage supply terminal (–) 5. In the circuit shown in FIG. 3, the voltage applied to the reference voltage input terminal 7 is selected so that it is higher than the voltage of the driving voltage supply terminal (–) 5, and lower than the voltage derived by adding the forward voltage $V_F$ of the normal LED to the voltage of the driving voltage supply terminal (–) 5.

In case that the LED 1 is normally operating and the transistor 2 turns on, the positive input terminal of the comparator 3 is supplied with the voltage derived by adding the forward voltage $V_F$ of the normal LED 1 to the voltage of the driving voltage supply terminal (–) 5. Since this voltage is higher than the reference voltage supplied to the negative input terminal of the comparator 3, the output voltage of the comparator 3 is at H level, and H level is applied to a faulty signal output terminal 8. In case the LED 1 is not normally operating, that is to say, in case that the LED 1 is short-circuited by a fault, the input voltage of the positive input terminal of the comparator 3 is lower than the reference voltage, and L level is applied to the faulty signal output terminal 8. In this way, in case that the potential of the faulty signal output terminal 8 is at H level, the LED 1 is normally operating, and in case that the same is at L level, the LED 1 is faulty.

In the LED array shown in FIG. 2 or FIG. 3, each LED 1 is provided with the comparator 3, and the number of the LEDs is the same as that of the faulty signal output terminals 8. Then, according to the LED array mentioned in the above, faults of all the LEDs 1 can be detected at the same time. Accordingly, the time necessary for detecting faults of the LED array according to the invention is shorter than that of the conventional LED array, in which the LEDs are turned on one by one in regular order to detect the faulty LEDs.

In the LED array shown in FIG. 2 or FIG. 3, since there is no necessity for applying a particular signal for inspection to the LED, the faulty LED can be detected even in case that an optical printer is operating.

Furthermore, since the LED array is provided with the reference voltage input terminal 7 for receiving the variable reference voltage, a fault other than a short-circuit one, such as an open-circuit fault or the existence of a deteriorating LED for instance, can be detected by changing the reference voltage supplied from a reference voltage-generating circuit situated on the outside of the LED array.

Figure 4:
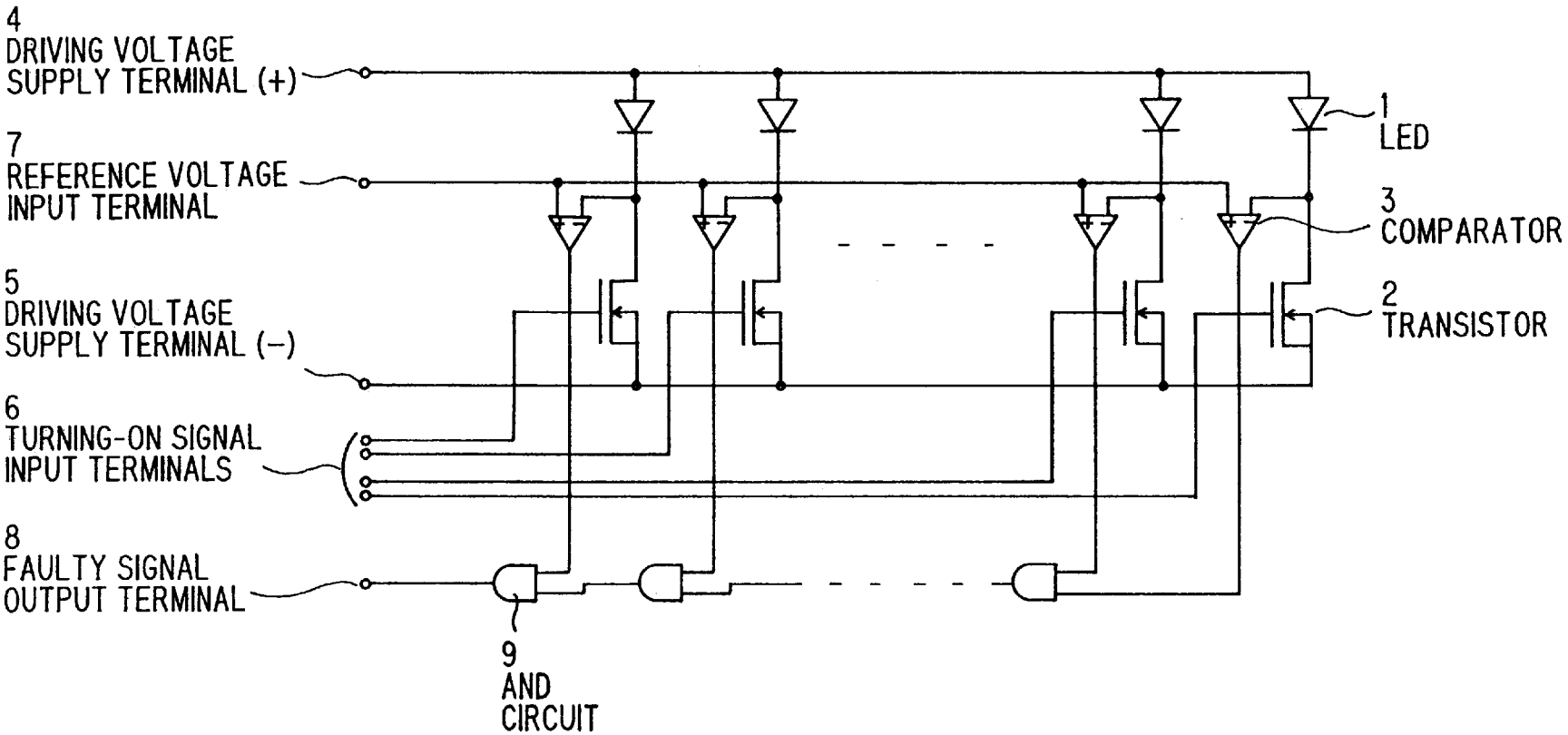
FIG. 4 is a circuit diagram for showing a LED array according to the third preferred embodiment of the invention.

FIG. 4 shows the third preferred embodiment of the invention.

The LED array can be obtained by adding plural cascaded AND circuits 9, each having two input terminals, to the LED array shown in FIG. 2, the input terminals of the AND circuit 9 of the first stage are respectively connected with output terminals of the comparators 3 of the first and second stages, the input terminals of the AND circuit 9 of a later stage are respectively connected with the output terminals of the comparators 3 of the same and previous stages, and the output terminal of the last AND circuit 9 is connected with a faulty signal output terminal 8. According to the LED array shown in FIG. 4, H level is applied to the faulty signal output terminal 8, only when all the LEDs 1 are normally operating; and L level is applied to the faulty signal output terminal 8, even when one of the LEDs 1 is faulty. Accordingly, whether a faulty LED exists or not can be instantaneously discriminated from the output level of the faulty signal output terminal 8. When a logical circuit, which respectively generates L and H levels in case that a LED is normal and faulty, is used, AND circuits should be replaced with OR circuits.

Figure 5:
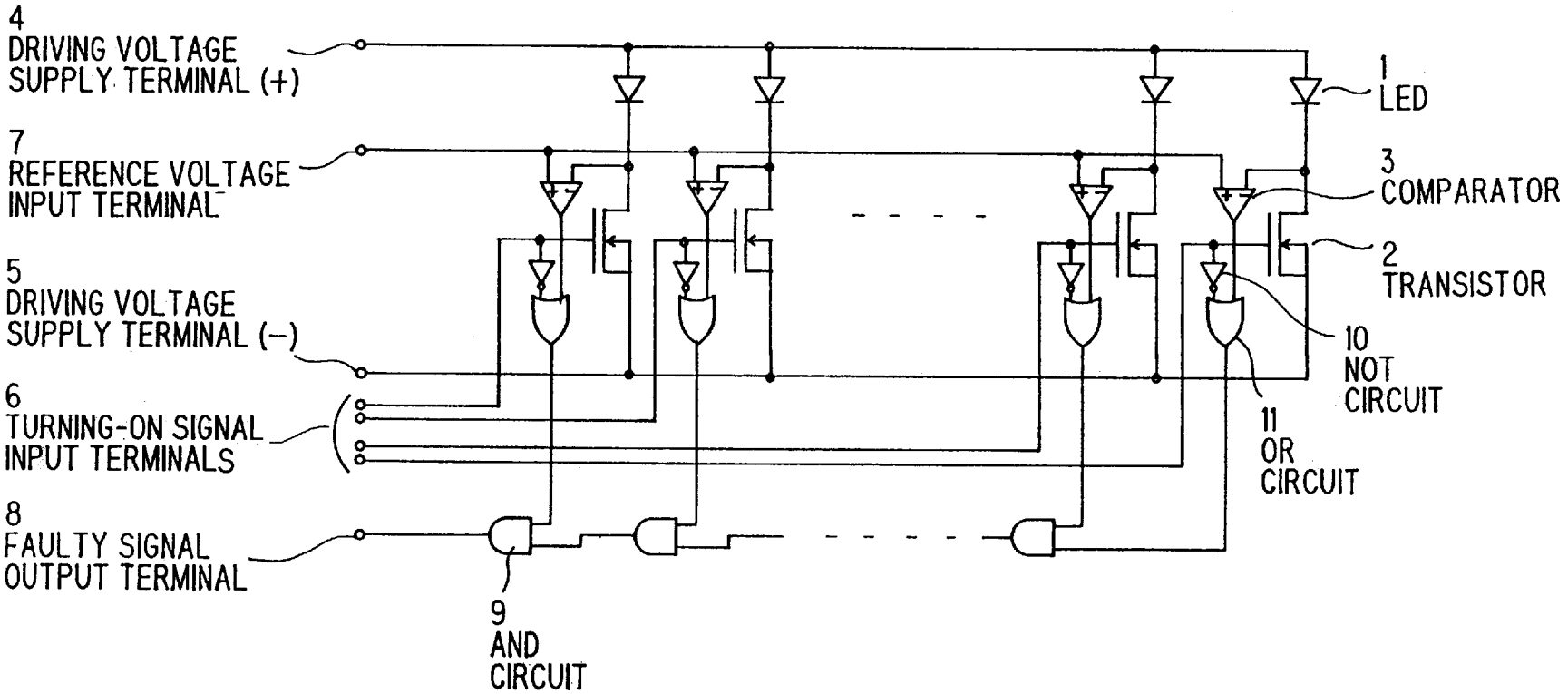
FIG. 5 is a circuit diagram for showing a LED array according to the fourth preferred embodiment of the invention.

FIG. 5 shows the fourth preferred embodiments of the invention.

This LED array can be obtained by adding plural logical circuits, each of which carries out logical operation based on a turning-on signal supplied to a gate of a transistor 2 and an output of a comparator 3, to the LED array shown in FIG. 4. The logical circuit is composed of a not circuit 10 for inverting the turning-on signal, which is respectively at H and L levels in case that the LED 1 is turned on and off, and an OR circuit 11, which derives a logical sum of the inverted turning-on signal and an output of a comparator 3. An output of the OR circuit 11 is supplied to an input terminal of an AND circuit 9.

As mentioned in the above, the output of the comparator 3 is at H level in case that the LED 1 is normally operating, hence the output of the OR circuit 11 is at H level in either case that the turning-on signal is at H or L level. Under condition that the LED 1 is short-circuited by a fault and the output of the comparator 3 is at L level, when the turning-on signal is at H level (the output of the NOT circuit 10 is at L level) , the output of the OR circuit is at L level; and when the turning-on signal is at L level (the output of the NOT circuit is at H level) , the output of the OR circuit 11 is at H level. That is to say, L level is applied to a faulty signal output terminal 8, only when the transistor 2 is turned-on and the LED driven thereby is short circuited. In case that the transistor 2 is turned off, H level is applied to the faulty signal output terminal 8, even if the corresponding LED is short circuited by a fault.

In the aforementioned LED array, if the LEDs are turned on one by one in regular order and the output of the faulty signal output terminal 8 is simultaneously checked, a faulty LED can be specified therethrough, because L level is applied to the faulty signal output terminal 8, when the LED 1 under inspection is faulty.

Figure 6:
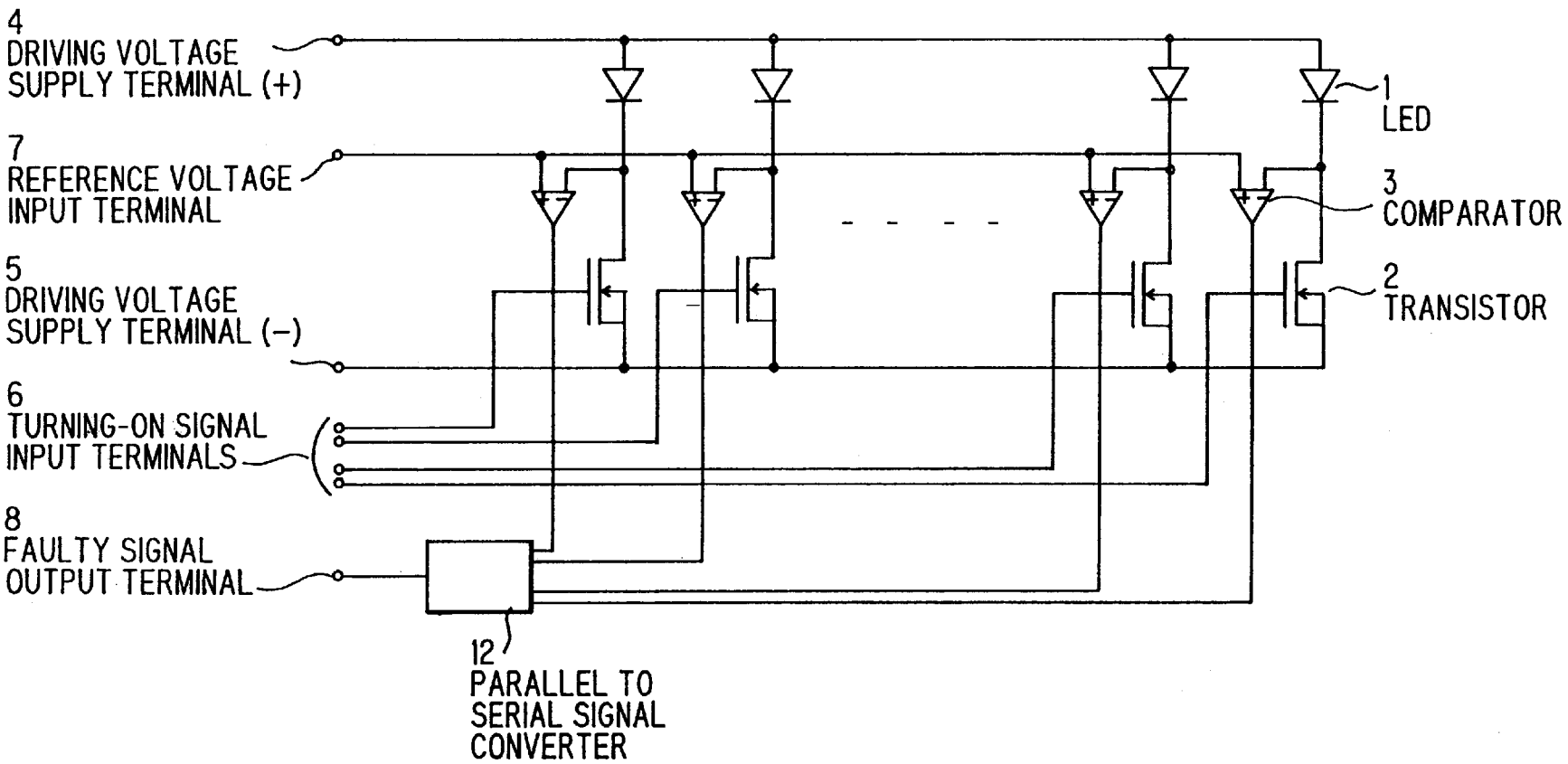
FIG. 6 is a circuit diagram for showing a LED array according to the fifth preferred embodiment of the invention.

FIG. 6 shows the fifth preferred embodiment.

This LED array can be obtained by adding a parallel to serial signal converter 12 to the same shown in FIG. 2, and the output of the comparators 3 are supplied to input terminals of the parallel to serial signal converter 12, an output terminal of which is connected with the faulty signal output terminal 8.

According to the LED array shown in FIG. 6, since a parallel signal composed of the output data of the comparators 3 is converted into a serial signal on the basis of a certain clock signal, a faulty diode can be specified by checking the serial signal synchronizing with the clock signal, hence the faulty signal output terminals 8 can be unified.

Figure 7:
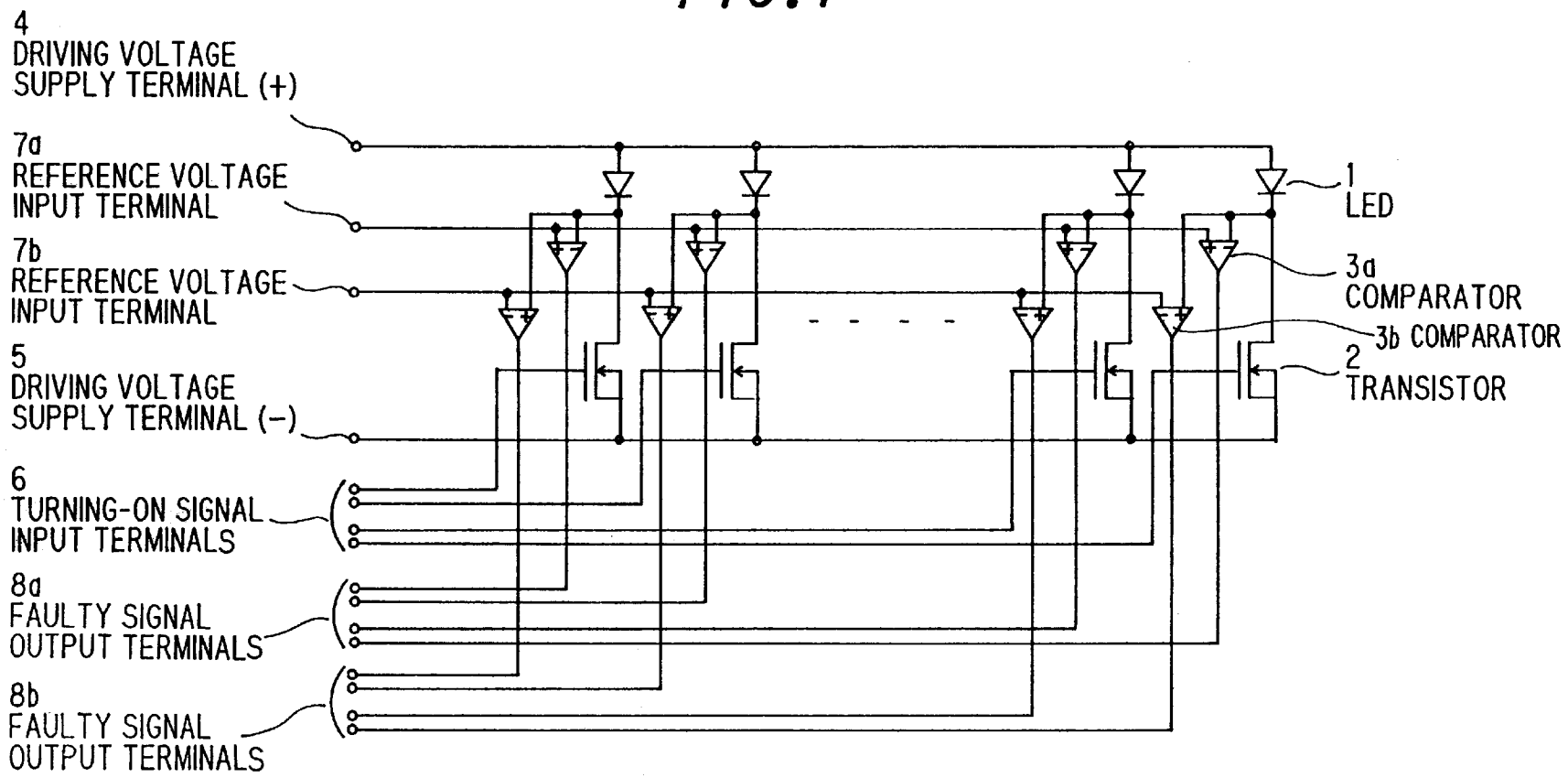
FIG. 7 is a circuit diagram for showing a LED array according to the sixth preferred embodiment of the invention.

FIG. 7 shows the sixth preferred embodiment of the invention.

The LED array shown in FIG. 7 can be obtained by connecting one more comparator to each LED in the LED array shown in FIG. 2. Furthermore, a reference voltage input terminal and a faulty signal output terminal are respectively connected with each of the newly connected comparators. A negative input terminal of a comparator 3*a* is connected with a cathode of the LED 1, a positive input terminal of the comparator 3*a* is connected with a reference voltage terminal 7*a*, and an output terminal of the comparator 3*a* is connected with a faulty signal output terminal 8*a*. On the other hand, a positive input terminal of a comparator 3*b* is connected with a cathode of the LED 1, a negative input terminal of the comparator 3*b* is connected with a reference voltage input terminal 7*b*, and an output terminal of the comparator 3*b* is connected with a faulty signal output terminal 8*b*.

A voltage supplied to the reference voltage input terminal 7*a* is lower than a voltage of the driving voltage supply terminal (+) 4 and higher than a voltage derived by subtracting a forward voltage $V_F$ of the normal LED from a voltage of the driving voltage -supply terminal (+) 4. A voltage supplied to the reference voltage supply terminal 7*b* is lower than a voltage derived by subtracting the forward voltage $V_F$ of the normal diode form a voltage of the driving voltage supply terminal (+) 4.

An operation of the comparator 3*a* is similar to that of the comparator 3 mentioned in explanation on FIG. 2. In case that the LED 1 is normally operating, H level is applied to the faulty signal output terminal 8*a*. In case that the LED 1 is faulty and short-circuited, L level is applied to the faulty signal output terminal 8*a*.

In the comparator 3*b*, in case that the LED 1 is normally operating and a transistor 2 is turned on, a voltage applied to a positive input terminal of the comparator 3*b* is equal to a voltage derived by subtracting the forward voltage $V_F$ of the normal LED from the voltage of the driving voltage supply terminal (+) 4. Since this voltage is higher than the reference voltage applied to negative input terminal of the comparator 3*b*, a potential of the output terminal of the comparator 3*b* is at H level. In case that the LED 1 is faulty and open-circuited, a voltage is not applied to the positive input terminal of the comparator 3*b* from the LED 1. In such a case, since the voltage of the positive input terminal of the comparator 3*b* is lower than the reference voltage supplied to the negative input terminal of the same, L level is applied to the faulty signal output terminal 8*b*.

As mentioned in the above, a faulty diode can be detected in either case that it is short-circuited or open-circuited. By providing each of the LEDs in the LED array shown in FIG. 3 with two comparators, this LED array can fulfill function of detecting a faulty diode in either case that it is short-circuited or open-circuited also.

The effects of the invention can be summarized as follows.

(1) Since each LED in the LED array is provided with a comparator and a faulty signal output terminal connected therewith, faults of all the LEDs can be instantaneously detected.

(2) Since fault of a diode is discriminated through a terminal voltage of the LED, fault of the LED can be detected, even when an optical printer is operating.

(3) Since a variable reference voltage can be applied to a reference voltage input terminal, various states of a faulty diode, such as a short-circuited or open-circuited LED, or a deteriorating LED, can be discriminated.

What is claimed is:

1. A light-emitting diode (LED, hereinafter) array comprising:

plural LEDs arranged along a predetermined line, plural comparators, each of which compares a voltage of a predetermined electrode of said each LED with a common reference voltage, and means for notifying existence of one or more faulty diodes based on outputs of said plural comparators, wherein said common reference voltage is changed in accordance with a kind of a fault of said LED to be inspected.

2. A LED array according to claim 1, wherein:

anode of said LEDs are connected with a positive terminal of a power supply, switching means for on/off controlling driving currents of said LEDs in accordance with turning-on signals applied thereto are connected between cathodes of said LEDs and a negative terminal of said power supply, and said common reference voltage is lower than said positive terminal voltage of said power supply and higher than a voltage derived by subtracting a forward voltage of said normal LED from said positive terminal voltage of said power supply (a first common reference voltage, hereinafter), or lower than said voltage drived by subtracting said forward voltage of said normal LED from said positive terminal voltage of said power supply (a second reference voltage, hereinafter).

3. A LED array according to claim 1, wherein:

cathodes of said LEDs are connected with a negative terminal of a power supply, switching means for on/off controlling driving currents of said LEDs in accordance with turning-on signals applied thereto are inserted between a positive terminal of a power supply and anodes of said LEDs, and said common reference voltage is higher than a negative terminal voltage of said power supply and lower than a voltage derived by adding a forward voltage of a normal LED to said negative terminal voltage of said power supply (a third reference voltage, hereinafter), or higher than said voltage derived by adding said forward voltage of said normal LED to said negative terminal voltage of said power supply (a fourth common reference voltage, hereinafter).

4. A LED array according to claim 2, wherein:

said means for notifying existence of said one or more faulty LEDs comprises logical circuits for respectively carrying out logical operations based on turning-on signals applied to said switching means and said outputs of said comparators.

5. A LED array according to claim 1, wherein:

said means for notifying existence of said one or more faulty LEDs comprises a parallel to serial signal converter for converting a parallel signal composed of said outputs of said plural comparators into a serial signal based on a certain clock signal.

6. A LED array according to claim 1, wherein:

said means for notifying existence of said one or more faulty LEDs comprises cascaded AND circuits, wherein one of two input terminals of said each AND circuit is connected with an output terminal of said comparator or logical circuit.

7. A LED array according to claim 6, wherein:

said turning-on signals are applied to said switching means one by one in regular order, and said one or more faulty LEDs are specified through an output signal of said cascaded AND circuits.

8. A LED array according to claim 2, wherein:

said LED to be inspected is regarded as faulty in case that a cathode voltage of said LED is discriminated to be higher than said first reference voltage by means of a first comparator, or lower than said second reference voltage by means of a second comparator.

9. A LED array according to claim 3, wherein:

said LED to be inspected is regarded as faulty in case that said anode voltage of said LED is discriminated to be lower than said third common reference voltage by means of a third comparator, or higher than said fourth common reference voltage by means of a fourth comparator.

10. A LED array according to claim 3, wherein:

said means for notifying existence of said one or more faulty LEDs comprises logical circuits for respectively carrying out logical operations based on turning-on signals applied to said switching means and said outputs of said comparators.

11. A LED array according to claim 4 wherein:

said means for notifying existence of said one or more faulty LEDs comprises and cascades AND circuits, wherein one of two input terminals of said each AND circuit is connected with an output terminal of said comparator or logical circuit.

12. A LED array according to claim 11 wherein:

said turning-on signals are applied to said switching means one by one in regular order, and said one or more faulty LEDs are specified through an output signal of said cascaded AND circuits.

13. A LED array according to claim 10 wherein:

said means for notifying existence of said one or more faulty LEDs comprises and cascades AND circuits, wherein one of two input terminals of said each AND circuit is connected with an output terminal of said comparator or logical circuit.

14. A LED array according to claim 13 wherein:

said turning-on signals are applied to said switching means one by one in regular order, and said one or more faulty LEDs are specified through an output signal of said cascaded AND circuits.

* * * * *